US006075524A

United States Patent [19]

Ruta

[11] Patent Number: 6,075,524

[45] Date of Patent: Jun. 13, 2000

[54] INTEGRATED ANALOG SOURCE DRIVER FOR ACTIVE MATRIX LIQUID CRYSTAL DISPLAY

[75] Inventor: Ronald Ruta, Mississauga, Canada

[73] Assignee: 1294339 Ontario, Inc., Toronto, Canada

[21] Appl. No.: 09/000,198

[22] PCT Filed: Jul. 28, 1995

[86] PCT No.: PCT/CA95/00450

§ 371 Date: May 15, 1998

§ 102(e) Date: May 15, 1998

[87] PCT Pub. No.: WO97/05596

PCT Pub. Date: Feb. 13, 1997

[51] Int. Cl.[7] ..... G09G 5/00

[52] U.S. Cl. ..... 345/210; 345/211; 345/212

[58] Field of Search ..... 345/210, 211, 345/212, 87, 100, 204, 205, 214

[56] References Cited

U.S. PATENT DOCUMENTS

| | | | |
|---|---|---|---|
| 5,243,333 | 9/1993 | Shiba et al. | 345/211 |
| 5,682,175 | 10/1997 | Kitamura | 345/100 |
| 5,798,742 | 8/1998 | Watatani et al. | 345/98 |
| 5,892,504 | 4/1999 | Knapp | 345/210 |

FOREIGN PATENT DOCUMENTS

| | | |
|---|---|---|
| 0 477 100 A1 | 9/1991 | European Pat. Off. . |
| 0 586 155 A3 | 8/1993 | European Pat. Off. . |
| 2 698 202 | 11/1992 | France . |
| 5241126 | 9/1993 | Japan . |
| 5297830 | 11/1993 | Japan . |

OTHER PUBLICATIONS

"High Speed Shift–Registers with CdSe–TFTs", Kai Schleupen, Ernst Lueder, University of Stuttgart, Germany.

*Primary Examiner*—Vijay Shankar
*Attorney, Agent, or Firm*—Fay, Sharpe, Fagan, Minnich & McKee, LLP

[57] ABSTRACT

A source driver for an active matrix liquid crystal display, comprising a sample-and-hold circuit for sampling successive lines of an input video signal, a source follower for applying successive lines of the input video signal sampled by the sample-and-hold circuit to successive source lines of the active matrix crystal display, the source follower being characterized by a predetermined threshold voltage; a reset circuit for resetting the successive source lines after respective ones of the successive lines of the input video signal; and an autozero circuit for cancelling the threshold voltage from the video signal so that variations in the threshold voltage do not affect the video signal applied to the successive source lines.

15 Claims, 2 Drawing Sheets

INTEGRATED ANALOG SOURCE DRIVER FOR ACTIVE MATRIX LIQUID CRYSTAL DISPLAY

FIELD OF THE INVENTION

This invention relates generally to active-matrix liquid crystal displays (AMLCDs), and more particularly to an analog source driver integrated directly on an AMLCD.

BACKGROUND OF THE INVENTION

Silicon integrated circuits are well known in the art for driving LCDs. Prior art drivers which are fabricated separately from the LCD may be manufactured with transistor characteristics which can be matched reasonably well, and operational amplifier type feedback circuitry can be used to reduce the gain and offset variations between channels.

It is also known in the prior art to incorporate drivers for AMLCDs directly on the LCD glass. Integral drivers have been designed in an effort to eliminate expensive prior art separate driver integrated circuits (ICs) and unreliable edge interconnections between the drivers and AMLCDs, thereby reducing overall system cost and size of the optical heads incorporating the AMLCDs.

However, it is not a simple matter to design such integrated drivers since it is difficult to manufacture TFT operational amplifiers as the output stages would be required to consist of plural TFTs connected in series across the power rails. It would not be possible to prevent all of the series pairs of TFTs on such an integrated driver from conducting simultaneously. This would result in non-uniformity and poor performance in some cases would short circuit the power supply.

There have been several approaches suggested in the prior art for the design of integrated TFT (Thin Film Transistor) gate drivers. A gate driver functions basically as a shift register. Consequently, prior art integrated gate drivers have been designed using drain clocking circuitry for achieving low power dissipation in NMOS CdSe TFTs comparable to that normally associated with CMOS devices. One such prior art driver is set forth in an article of Schleupen, K., et al. entitled "An Integrated 4-bit Gray-Scale Column Driver for TV AMLCDs", 1994 SID Digest (Society for Information Display).

However, there has been less progress in the prior art toward a consensus on the design of TFT source drivers for AMLCDs. Indeed, there are presently two distinct approaches to the design of source drivers: digital and analog. Existing digital source drivers are known for providing multiple bit outputs (eg. a 4 bit digital driver can be implemented using four large capacitors and 21 TFTs), which are sufficient for low amplitude resolution applications such as aircraft instruments or simple on/off checklist displays. Although digital drivers are expandable to a larger number of bits, the device size approximately doubles for each added bit. By way of contrast, a single analog driver can be designed which is suitable for any size of display. Such a design should utilize no resistors, should be capable of implementation in NMOS enhancement mode and must be compatible with the active matrix TFTs (ie. identical thickness of semiconductor material).

A source driver comprises three basic functional blocks: an input video multiplexer, a storage device, and an output drive stage. The input video multiplexer and storage device may be connected in series or may effectively be connected in parallel if a double buffered sample-and-hold (S/H) is provided.

In the parallel embodiment, two or more S/Hs per output line, requiring one TFT per S/H, are addressed for writing on alternate lines and reading on other lines in accordance with the display pixel format and the video input format. The output of the S/Hs are multiplexed onto one output driver by additional TFTs, one per S/H, requiring four TFTs for the minimum implementation.

For the series embodiment, the input S/Hs are loaded in succession after which the stored data is loaded broadside into another parallel S/H which functions as an analog register. The series embodiment reduces the device input capacitance and only requires two TFTs for the minimum implementation but reduces the voltage to the driver since the charge on the first S/H must also drive the second S/H without amplification. The second TFT must be characterized by a low resistance for transferring the charge in a short deadtime between switching since the first row of TFTs cannot be permitted to receive signal again until the transfer has been completed. The capacitors in the series S/H topology need only be of sufficient size to provide drive current for the duration of one line since that is all the storage time that is needed. However, the presence of two series stages tends to increase the switching noise. The double-buffered S/H needs twice the capacitance since data loaded at the beginning of one line must be retained through the end of the next line.

The design of the output drive stage must take into consideration a number of criteria and limitations dictated by the requirements for integration with the display. An essential feature of the output driver stage is that it must provide accurate output for any load while remaining independent of TFT threshold voltage.

Digital and analog drivers have been proposed which use a capacitive output drive. However, these prior art designs are non-scalable to different direct-view applications since the output capacitor must be much larger than the combined capacitance of the source line and pixel capacitance (with one line of array TFTs on). Therefore, these prior art source drivers are restricted to use with very small displays for either projection or helmet-size direct viewing.

SUMMARY OF THE INVENTION

According to the present invention, an integrated analog source driver is provided which may be implemented using a minimal number of TFTs and capacitors (14 NMOS TFTs and 3 capacitors in the preferred embodiment), and no resistors or other types of devices. The integrated analog source driver of the present invention may be fabricated concurrently with the active matrix devices of a display, without requiring any additional process steps. The output impedance of the inventive integrated analog source driver is low enough to drive a broad selection of displays ranging from projection/helmet displays to workstation displays. According to the present invention, the driver characteristics are made independent of TFT characteristics through the use of a novel circuit architecture.

The integrated analog source driver of the preferred embodiment has two S/H stages, one being connected to the true analog video signal containing standard RGB-type information, etc., and the other being connected to the inverted analog video signal. Adjacent video lines are connected to opposite polarity video signals, and are switched after each line in such a way that the polarity of the video may be made to alternate in both row and column directions in the manner of a checkerboard, to minimize the DC signal component tending to dissociate the LCD fluid and polarize the alignment layer (although alternatives to the checkerboard polarity method may be utilized such as row inversion, column inversion, frame inversion, etc.). This alternation is further reversed every frame. The two S/H outputs per source driver are multiplexed onto the gate of a source follower TFT such that while one S/H is driving the output stage with the signal for the current line, the other S/H is acquiring the signal for the next line. The output stage is a source follower which drives one active matrix source line and is the top TFT in a totem-pole output stage. The bottom device of the totem pole is a reset TFT whose drain is also connected to the output source line. The source follower and reset TFTs are prevented from conducting current at the same time by switching off the source follower either by a second gate or by removing its supply voltage while the reset TFT is conducting.

An autozero circuit is connected to the output stage for cancelling the effect of TFT threshold voltage on the output source follower TFT. The autozero circuit operates such that the output voltage is driven to the signal level and then reset to the most negative voltage after the active matrix is disabled (by driving all matrix gates to the inactive state). The source follower gate is then grounded and the output voltage at the source line is stored on a capacitor whose other terminal is grounded. The voltage on this capacitor is reversed by grounding the opposite side and this voltage is then placed in series with the S/H capacitor which is currently driving the output. The output is reset again and then the S/H gate signal is connected in series with the autozero value in the capacitor. This combined signal is applied to drive the source follower for the next line. Autozeroing in this fashion counteracts the offset of the output source follower TFT so that variations in the threshold voltage of the TFT do not affect the output. Since the gain in a follower stage is slightly less than unity, regardless of TFT variations, no gain calibration is required.

BRIEF INTRODUCTION TO THE DRAWINGS

A detailed description of the preferred embodiment is provided herein below with reference to the drawings, in which:

FIG. 1 is a schematic diagram of an integrated analog source driver according to the present invention; and FIG. 2 is a timing diagram showing sequence of operation of the elements of the driver shown in FIG. 1.

DETAILED DESCRIPTION OF THE PREFERRED EMBODIMENT

Figure 1:
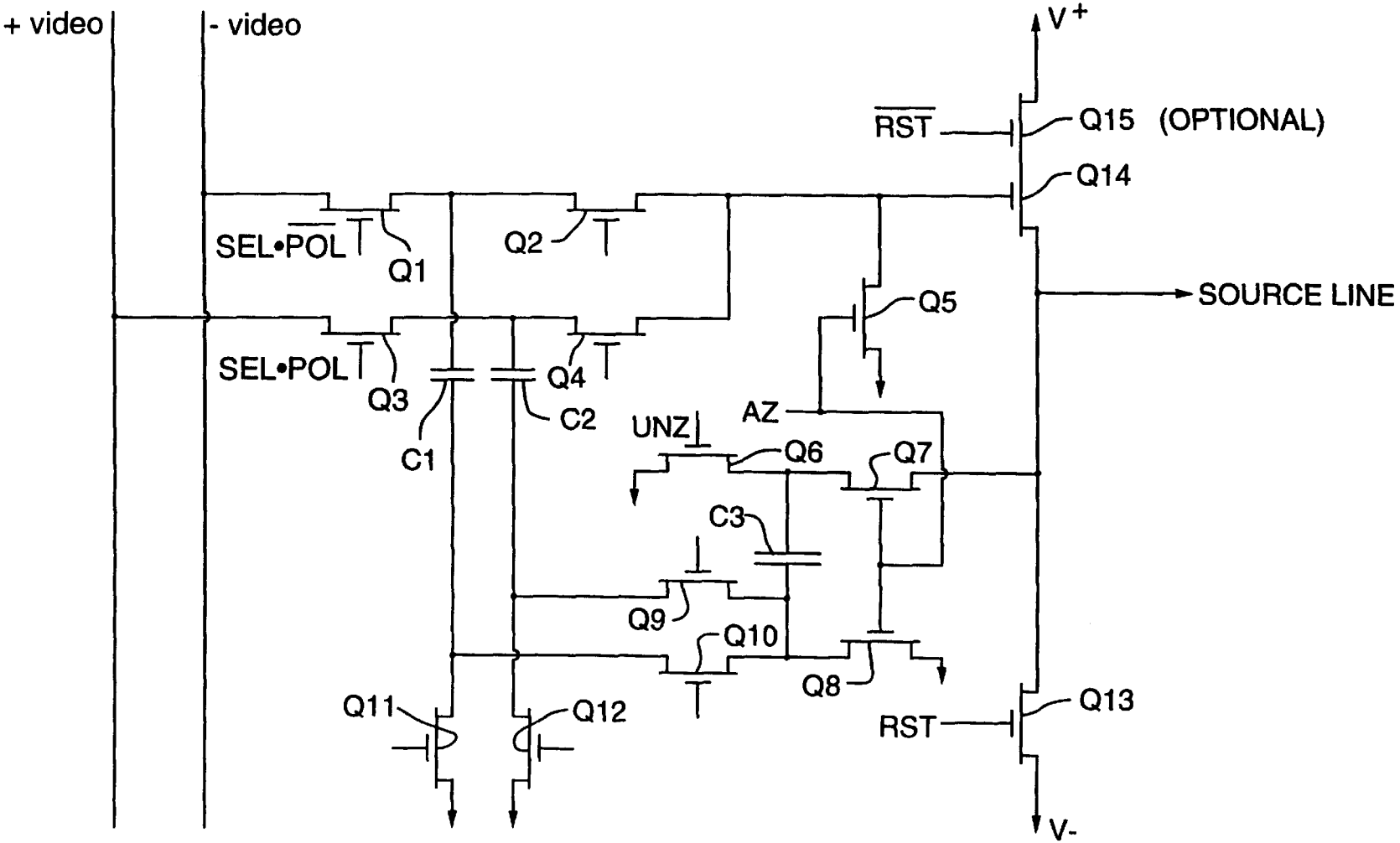
Figure 2:
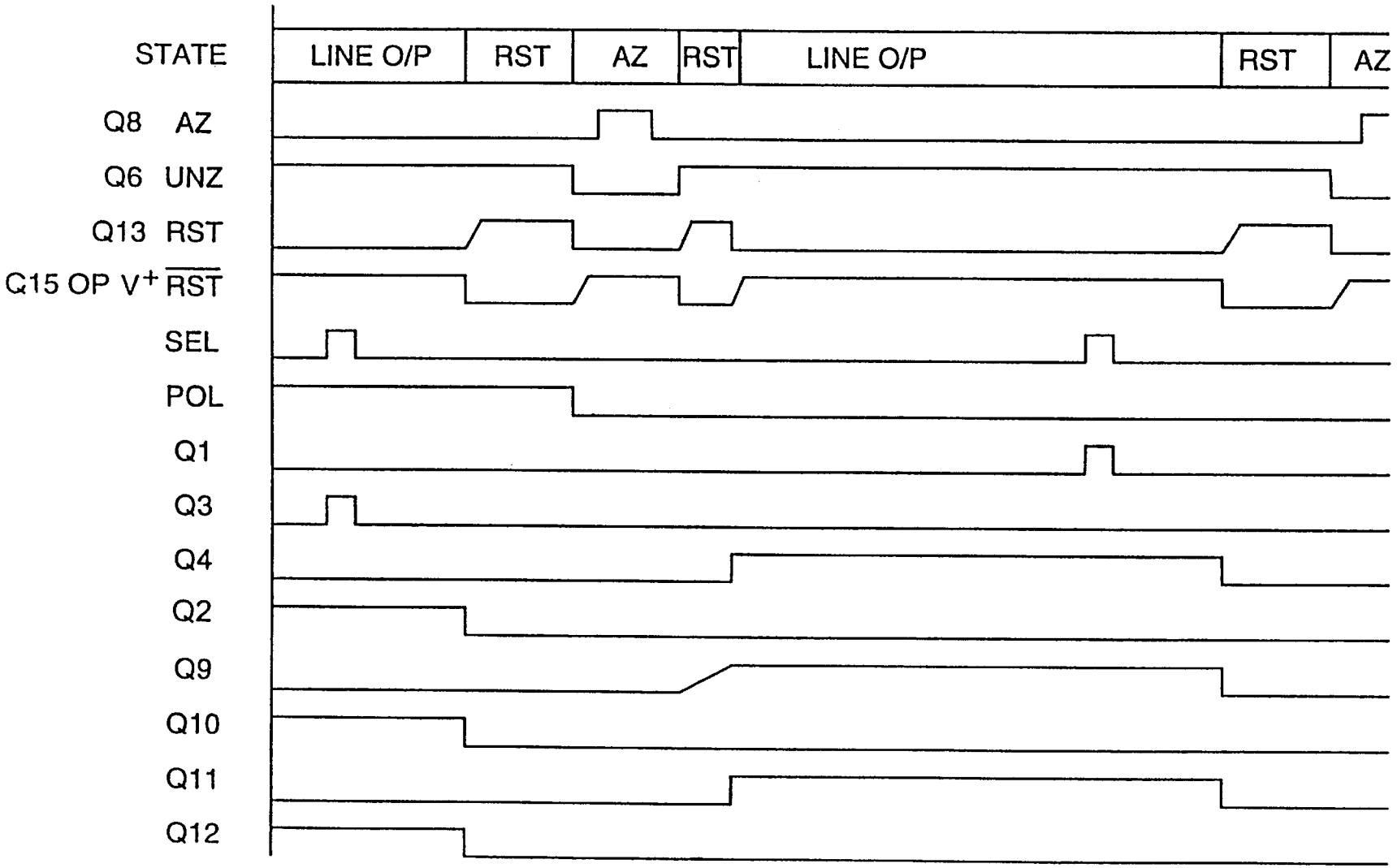

The integrated analog source driver shown in FIG. 1 uses a double-buffered input S/H (Q1, C1 and Q3, C2) driven by a shift register (not shown, but being of well known design). The shift register generates the Q1 and Q3 gating signals shown in FIG. 2. When either one of the TFTs Q1 or Q3 is conducting, the corresponding one of the analog video signals (+VIDEO, −VIDEO) is sampled via the associated storage capacitor C1 or C2. However, in order to sample the signals onto C1 or C2, TFTs Q11 or Q12, respectively, must be conducting so as to ground the lower terminal of the capacitors. The double-buffered S/H outputs are multiplexed to the driver stage (Q14 and Q15) by two TFTs Q2 and Q4, in accordance with the timing signals for Q2 and Q4 as shown in FIG. 2. A reset TFT Q13 is required to reset the output signal in the presence of large pixel capacitance on the output (SOURCE LINE).

The stored charge on C1 or C2 must have added to it a further charge equal to the threshold voltage ($V_t$) of the source follower Q14 to cancel the effects of the threshold voltage, and thereby eliminate threshold dependent non-uniformities superimposed on the signal applied to the SOURCE LINE which would otherwise occur. Therefore, as discussed in greater detail below, an autozero circuit is incorporated for biasing capacitors C1 and C2 via series connected capacitor C3 with a sufficient charge to cancel the TFT threshold voltage ($V_t$) of the source follower TFT Q14.

Thus, as shown in FIG. 2, there are four operational phases per video line. First, the true (or inverted) video signal is applied to the SOURCE LINE (denoted as LINE O/P in FIG. 2). The gates of the AMLCD TFT array switch on and off in the usual manner for the duration of the LINE O/P, for generating the required video signal via the array pixel electrodes (not shown) which are connected to the SOURCE LINE.

Next, a first reset (denoted as RST in FIG. 2) is performed, followed by the aforementioned autozero function (AZ in FIG. 2), and finally a second short reset (RST) is performed, as discussed in greater detail below.

The double-buffered input S/H design reduces insertion loss and input voltage requirements, and permits line-by-line video inversion without extra switching. Pixel-by-pixel inversion is effected by driving the alternate S/Hs in the same row by antiphase video sources (+VIDEO and −VIDEO). No external inversion is required.

As indicated above, the driver stage comprises a source follower TFT (Q14), shown in FIG. 1 with an upper cascode gate (Q15) which is used for switching only. As an alternative, two separate TFTs Q14 and Q15 may be used, or the $V^+$ supply may be gated externally without requiring TFT Q15. Also, as discussed above, a reset TFT (Q13) is connected to the output (SOURCE LINE) to pull down the output line voltage to a minimum voltage ($V^-$) before and after autozero capacitor C3 is charged. The first and second resets occur during the "deadtime" between LINE O/P phases, and must be able to discharge the SOURCE LINE capacitance (typically several hundred pF). Since each pixel of the AMLCD is driven by a video signal of opposite polarity to the one above (or before) it, it is possible for a maximum signal voltage to be followed by a minimum voltage. Therefore, the first reset must be of sufficient duration to permit the SOURCE LINE capacitance to be discharged. The second reset (after autozero) is only half as long as the first reset since the SOURCE LINE voltage is below ground voltage after autozeroing. Since the design includes no resistors, the capacitive load is reset to the negative rail ($V^-$), and after RST signal is released, the source follower drives the output (SOURCE LINE) to the sampled signal level.

The autozero circuit shown in FIG. 1 uses eight TFTs (Q5, Q6, Q7, Q8, Q9, Q10, Q11 and Q12) and one capacitor (C3). In operation, the driver input is grounded by switching TFT Q5 on with an autozero (AZ) signal. In response, the output voltage (which is negative and approximately equal in magnitude to the TFT threshold voltage $V_t$) is stored on capacitor C3 as a result of the AZ signal also switching TFTs Q7 and Q8 on while the unzero signal (UNZ) maintains TFT Q6 off and logic low gate signals maintain TFTs Q9 and Q10 in the off state. Accordingly, the polarity of the stored voltage is such that the capacitor plate connected to Q6 and Q7 is negative relative the plate connected to Q8, Q9 and Q10. Capacitor C3 is then electrically disconnected by switching off Q7 and Q8 (falling edge of AZ). Capacitor C3 is then electrically reconnected to the circuit by switching on TFT Q6 (rising edge of UNZ) and one of either Q9 or Q10

(in FIG. 2, Q9 is shown being switched on). The plate connected to Q6 and Q7 remains electrically negative relative to the plate connected to Q8, Q9 and Q10, but is electrically connected in such a way that the threshold voltage $V_t$ is added rather than subtracted from the signal stored on C1 or C2. Since the gain of the source follower is approximately unity, when voltage is inverted and placed on the gate of follower transistor Q14 by TFT Q6 and one of TFT Q9 or Q10, it drives the output (SOURCE LINE) to zero volts regardless of the actual value of $V_t$.

As can be seen from FIG. 2, the switching required to operate the driver of the present invention is somewhat complex since the basic video S/H circuitry requires four TFTs (Q1, Q2, Q3 and Q4) plus one transistor (Q5) to ground the gate of source follower TFT Q14, and double-throw switching of the bottom terminals of S/H capacitors C1 and C2 between ground and the autozero capacitor C3 through Q9, Q10, Q11 and Q12. Each side of the double buffer input must be connected separately to the autozero capacitor C3 since when one of C1 or C2 is connected to the autozero capacitor C3 the other S/H capacitor must be grounded to store the input video signal. The TFTs (Q5–Q12) and capacitor C3 used for autozeroing are preferably the same (small) size as the S/H TFTs and capacitors.

The total parts count of 14 (or 15) TFTs and 3 capacitors for implementing the all-purpose analog driver of FIG. 1 compares favourably with the 21 TFTs and 8 capacitors used in the prior art 4-bit non-scalable switched-capacitor driver described in the article of Schleupen, K., et al., discussed above. It should be noted that this parts count does not include the TFTs used in the shift register (not shown) for addressing the S/H inputs nor the gates (not shown) used to generate the Q1 and Q3 switching waveforms. Depending on the structure of the input S/H circuits (there may be more than two S/H circuits per channel), a S/H circuit fed by the video signal of either polarity must be activated for each input. Which input S/H circuit is activated depends on the polarity of the signal to be applied to the output. In the embodiment shown, either Q1 or Q3 would be selected. Accordingly, this may be effected by using a pair of shift registers with output gating that selects which one of Q1 or Q3 will be switched on. This selection logic would require the sampling pulses to be demultiplexed either at the shift register output or by the use of cascode TFTs as input sampling devices. The former is preferable since gating at the shift register output does not degrade signal integrity whereas double-gate devices for Q1 and Q3 would likely inject extra switching noise. The shift register and the additional switching gates are not shown because they form part of the prior art, they are ancillary to and do not form a part of the actual circuit of the invention as set forth in the claims below.

In summary, the integrated analog source driver of the present invention overcomes the advantages of prior art p-Si and CdSe integrated source driver designs which use capacitive drives and which are only suitable for small displays, by providing a driver which is suitable as a "one-size-fits-all" solution for any size of display. It is believed to be hitherto unknown in the art to use autozeroing as a means of obtaining linear current amplification with independence from TFT threshold characteristics. Furthermore, the driver is processed (ie. fabricated) concurrently with the array TFTs and therefore requires no new processes or extra processing steps and current amplification is provided. The small number of circuit elements (TFTs and capacitors—no resistors) allows the driver of the present invention to be made smaller than existing drivers for use with small pixel pitches, which is an important commercial consideration for high-resolution helmet and projection display applications. The output impedance of the integrated driver of the present invention is sufficiently low to drive the source line capacitance of a large display panel, and the driver input impedance is high. The driver speed is compatible with video inputs. For wideband video, a plurality of separate inputs may be provided to reduce bandwidth requirements. Also, video inversion may be effected in a straightforward manner Other embodiments and variations of the invention are possible For example, the input circuitry may be made according to a variety of designs to suit different input and pixel arrangements and polarity schemes. Also, the driver can be fabricated from a number of suitable semiconductor materials, such as amorphous silicon, polycrystalline silicon, single-crystal silicon, gallium arsenide, germanium-silicon as well as cadmium selenide. All such alternative embodiments and variations are believed to be within the scope of the present invention having regard to the claims appended hereto.

I claim:

1. A source driver for an active matrix liquid crystal display, comprising:

a) a sample-and-hold circuit for sampling successive lines of an input video signal;

b) a source follower for applying said successive lines of said input video signal sampled by said sample-and-hold circuit to successive source lines of said active matrix crystal display, said source follower being characterized by a predetermined threshold voltage;

c) a reset circuit for resetting said successive source lines after respective ones of said successive lines of said input video signal; and d) an autozero circuit for cancelling said threshold voltage from said video signal so that variations in the threshold voltage do not affect the video signal applied to said successive source lines by driving an output voltage to a level of said video signal level and then resetting said output voltage to a negative voltage after said active matrix liquid crystal display is disabled.

2. The source driver of claim 1, wherein said sample-and-hold circuit further comprises a first sample-and-hold stage for receiving said video signal and a second sample-and-hold stage connected in parallel with said first sample-and-hold stage for receiving an inverted version of said video signal, said first sample-and-hold stage being addressed for sampling alternate ones of said lines of video signal and said second sample-and-hold stage being addressed for sampling intermediate alternate ones of said lines of video signal.

3. The source driver of claim 2, further comprising a multiplexer for applying the opposite polarity video signals sampled by said sample-and-hold circuit to said source follower such that the polarity of the video signal alternates in both row and column directions of said active matrix liquid crystal display in the manner of a checkerboard.

4. A source driver for an active matrix liquid crystal display, comprising:

a) a sample-and-hold circuit for sampling successive lines of an input video signal, said sample-and-hold circuit including a first sample-and-hold stage for receiving said video signal and a second sample-and-hold stage connected in parallel with said first sample-and-hold stage for receiving an inverted version of said video signal, said first sample-and-hold stage being addressed for sampling alternate ones of said lines of video signal and said second sample-and-hold stage being addressed for sampling intermediate alternate ones of said lines of video signal, said first sample-and-hold stage comprises a first capacitor and a first pair of switching transistors connected to opposite terminals of said first capacitor for gating said video signal into said first capacitor, and said second sample-and-hold stage comprises a second capacitor and a second pair of switching transistors connected to opposite terminals of said second capacitor for gating said inverted version of said video signal into said second capacitor;

b) a source follower for applying said successive lines of said input video signal sampled by said sample-and-hold circuit to successive source lines of said active matrix crystal display, said source follower being characterized by a predetermined threshold voltage;

c) a reset circuit for resetting said successive source lines after respective ones of said successive lines of said input video signal; and d) an autozero circuit for canceling said threshold voltage from said video signal so that variations in the threshold voltage do not affect the video signal applied to said successive source lines; and e) a multiplexer for applying the opposite polarity video signals sampled by said sample-and-hold circuit to said source follower such that the polarity of the video signal alternates in both row and column directions of said active matrix liquid crystal display in the manner of a checkerboard.

5. The source driver of claim 4, wherein said multiplexer comprises a first additional switching transistor for gating said alternate ones of said lines of video signal stored on said first capacitor to said source follower while said second sample-and-hold stage samples said intermediate alternate ones of said lines of video signal, and a second additional switching transistor for gating said intermediate alternate ones of said lines of video signal stored on said second capacitor to said source follower while said first sample-and-hold stage samples said alternate ones of said lines of video signal.

6. The source driver of claim 5, wherein said source follower further comprises a linear transistor having a signal input connected to said first and second additional switching transistors, a first signal terminal connected to a source of positive voltage supply and a second signal terminal connected to said source lines.

7. The source driver of claim 6, wherein said reset circuit further comprises a third additional switching transistor connected in totem pole configuration between said linear transistor and a source of negative voltage supply.

8. The source driver of claim 7, wherein said autozero circuit further comprises a fourth additional switching transistor for grounding said signal input of said linear transistor, fifth and sixth additional switching transistors connected to first and second terminals of a third capacitor for storing the output voltage on said source lines on said third capacitor, said output voltage being equivalent to said threshold voltage, a seventh switching transistor connected to said first terminal of said third capacitor and eighth and ninth switching transistors each connected to the second terminal of said third capacitor and respectively to said first capacitor and said second capacitor for connecting said third capacitor in series with respective ones of said first and second capacitors thereby cancelling said threshold voltage.

9. A source driver for an active matrix liquid crystal display, comprising:

a) a sample-and-hold circuit for sampling successive lines of an input video signal;

b) a source follower for applying said successive lines of said input video signal sampled by said sample-and-hold circuit to successive source lines of said active matrix crystal display, said source follower being characterized by a predetermined threshold voltage;

c) a reset circuit for resetting said successive source lines after respective ones of said successive lines of said input video signal; and d) an autozero circuit for canceling said threshold voltage from said video signal so that variations in the threshold voltage do not affect the video signal applied to said successive source lines;

wherein said sample-and-hold circuit comprises a first sample-and-hold stage for receiving said video signal and a second sample-and-hold stage connected in parallel with said first sample-and-hold stage for receiving an inverted version of said video signal; and wherein said first sample-and-hold stage comprises a first capacitor and a first pair of switching transistors connected to opposite terminals of said first capacitor for gating said video signal into said first capacitor, and said second sample-and-hold stage comprises a second capacitor and a second pair of switching transistors connected to opposite terminals of said second capacitor for gating said inverted version of said video signal into said second capacitor.

10. The source driver of claim 9 wherein said first sample-and-hold stage is addressed for sampling alternate ones of said lines of video signal and said second sample-and-hold stage is addressed for sampling intermediate alternate ones of said lines of video signal.

11. The source driver of claim 10, further comprising a multiplexer for applying the opposite polarity video signals sampled by said sample-and-hold circuit to said source follower such that the polarity of the video signal alternates in both row and column directions of said active matrix liquid crystal display in the manner of a checkerboard.

12. The source driver of claim 11, wherein said multiplexer comprises a first additional switching transistor for gating said alternate ones of said lines of video signal stored on said first capacitor to said source follower while said second sample-and-hold stage samples said intermediate alternate ones of said lines of video signal, and a second additional switching transistor for gating said intermediate alternate ones of said lines of video signal stored on said second capacitor to said source follower while said first sample-and-hold stage samples said alternate ones of said lines of video signal.

13. The source driver of claim 12, wherein said source follower further comprises a linear transistor having a signal input connected to said first and second additional switching transistors, a first signal terminal connected to a source of positive voltage supply and a second signal terminal connected to said source lines.

14. The source driver of claim 13, wherein said reset circuit further comprises a third additional switching transistor connected in totem pole configuration between said linear transistor and a source of negative voltage supply.

15. The source driver of claim 14, wherein said autozero circuit further comprises a fourth additional switching transistor for grounding said signal input of said linear transistor, fifth and sixth additional switching transistors connected to first and second terminals of a third capacitor for storing the output voltage on said source lines on said third capacitor, said output voltage being equivalent to said threshold voltage, a seventh switching transistor connected to said first terminal of said third capacitor and eighth and ninth switching transistors each connected to the second terminal of said third capacitor and respectively to said first capacitor and said second capacitor for connecting said third capacitor in series with respective ones of said first and second capacitors thereby canceling said threshold voltage.

* * * * *